United States Patent [19]

Bernauer

[11] 4,226,213

[45] Oct. 7, 1980

[54] INTERNAL COMBUSTION ENGINE

[75] Inventor: Otto Bernauer, Weinstadt, Fed. Rep. of Germany

[73] Assignee: Daimler-Benz Aktiengesellschaft, Fed. Rep. of Germany

[21] Appl. No.: 954,125

[22] Filed: Oct. 24, 1978

[30] Foreign Application Priority Data

Nov. 11, 1977 [DE] Fed. Rep. of Germany ..... 2750463

[51] Int. Cl.[3] ..... F02B 43/00; F02M 31/00

[52] U.S. Cl. ..... 123/1 A; 123/3; 123/DIG. 12; 123/557

[58] Field of Search ..... 123/1 A, 3, 122 E, DIG. 12

[56] References Cited

U.S. PATENT DOCUMENTS

| | | | |
|---|---|---|---|
| 2,295,209 | 9/1942 | Guiles et al. | 123/3 |
| 2,298,214 | 10/1942 | Jones | 123/122 E |
| 3,986,486 | 10/1976 | Rabbiosi | 123/122 E |
| 4,016,836 | 4/1977 | MacKay et al. | 123/3 |
| 4,031,865 | 1/1977 | Dufour | 123/DIG. 12 |

*Primary Examiner*—Charles J. Myhre
*Assistant Examiner*—Craig R. Feinberg
*Attorney, Agent, or Firm*—Craig & Antonelli

[57] ABSTRACT

An internal combustion engine with walls delimiting the working space or spaces of the internal combustion engine, in which a hydrogen-impervious, encapsulated metal hydride storage device is provided which is in heat-conducting contact with these walls; the interior of the encapsulation is adapted to be selectively connected to a source of hydrogen and/or to a separate further hydrogen storage device.

8 Claims, 4 Drawing Figures

INTERNAL COMBUSTION ENGINE

The present invention relates to an internal combustion engine with walls adapted to be cooled and delimiting the working space or spaces of the internal combustion engine.

During the warm-up phase of internal combustion engines, the proportion of harmful components in the exhaust gas is particularly high because the combustion processes are imperfect and incomplete during the warm-up phase for the most varied reasons. In addition to many attempts for reducing the discharge of harmful exhaust gas components, one also seeks to shorten the warm-up phase of the engine. This, however, requires either an increased energy expenditure or a constructive, respectively, manufacturing expenditure which can hardly be accepted, or also both together.

It is the aim of the present invention to provide a measure for the shortening of the warm-up phase of the engine, in connection with which no additional energy is required and which is simple in construction.

The underlying problems are solved according to the present invention in that a hydrogen-impervious, encapsulated metal hydride storage device is provided in direct heat-conducting contact or indirectly by way of a convective heat-exchanging connection with the walls and in that the interior of the encapsulation is adapted to be connected selectively to a hydrogen source and/or to a separate further hydrogen storage device.

As known, certain metals, respectively, metal alloys possess the property to absorb hydrogen into their crystalline structure and to thereby give off heat. With an external heat supply and/or at low hydrogen pressures, these metals again release the hydrogen. It thereby involves a completely reversible process which can be repeated as frequently as desired. For purposes of warming-up the internal combustion engine prior to or during the start, hydrogen is supplied to the pre-heat storage device which absorbs the same within itself and is thereby heated up. The pre-heat storage device releases this heat at least indirectly to the combustion space walls. With an engine at warmed-up operating temperatures, the hydrogen bound during the starting phase is again released out of the pre-heat storage device by the engine heat and is absorbed in a hydrogen storage device taken along in the vehicle, whereby it is then available again for a renewed cold starting operation. Consequently, operating waste heat of the engine is temporarily stored hydrated, so to speak of, so that the heat quantity necessary for the warm-up of the engine prior to or during the cold start takes place by means of temporarily stored engine waste heat, i.e., energy-free.

Accordingly, it is an object of the present invention to provide an internal combustion engine which avoids by simple means the aforementioned shortcomings and drawbacks encountered in the prior art.

Another object of the present invention resides in an internal combustion engne in which the exhaust of harmful exhaust gas components is significantly reduced during cold starting.

A further object of the present invention resides in an internal combustion engine in which the warm-up phase of the engine can be considerably shortened by extremely simple means.

Still a further object of the present invention resides in an internal combustion engine with improved exhaust gas quality during the cold start and with reduced warm-up phase of the engine, which does not require increased expenditures involved in the constructive or manufacturing aspects thereof.

Still another object of the present invention resides in an internal combustion engine which permits a reduction of the warm-up phase of the engine with requiring any additional energy, yet is extraordinarily simple in construction.

These and other objects, features and advantages of the present invention will become more apparent from the following description when taken in connection with the accompanying drawing which shows, for purposes of illustration only, two embodiments in accordance with the present invention, and wherein.

Figure 1:
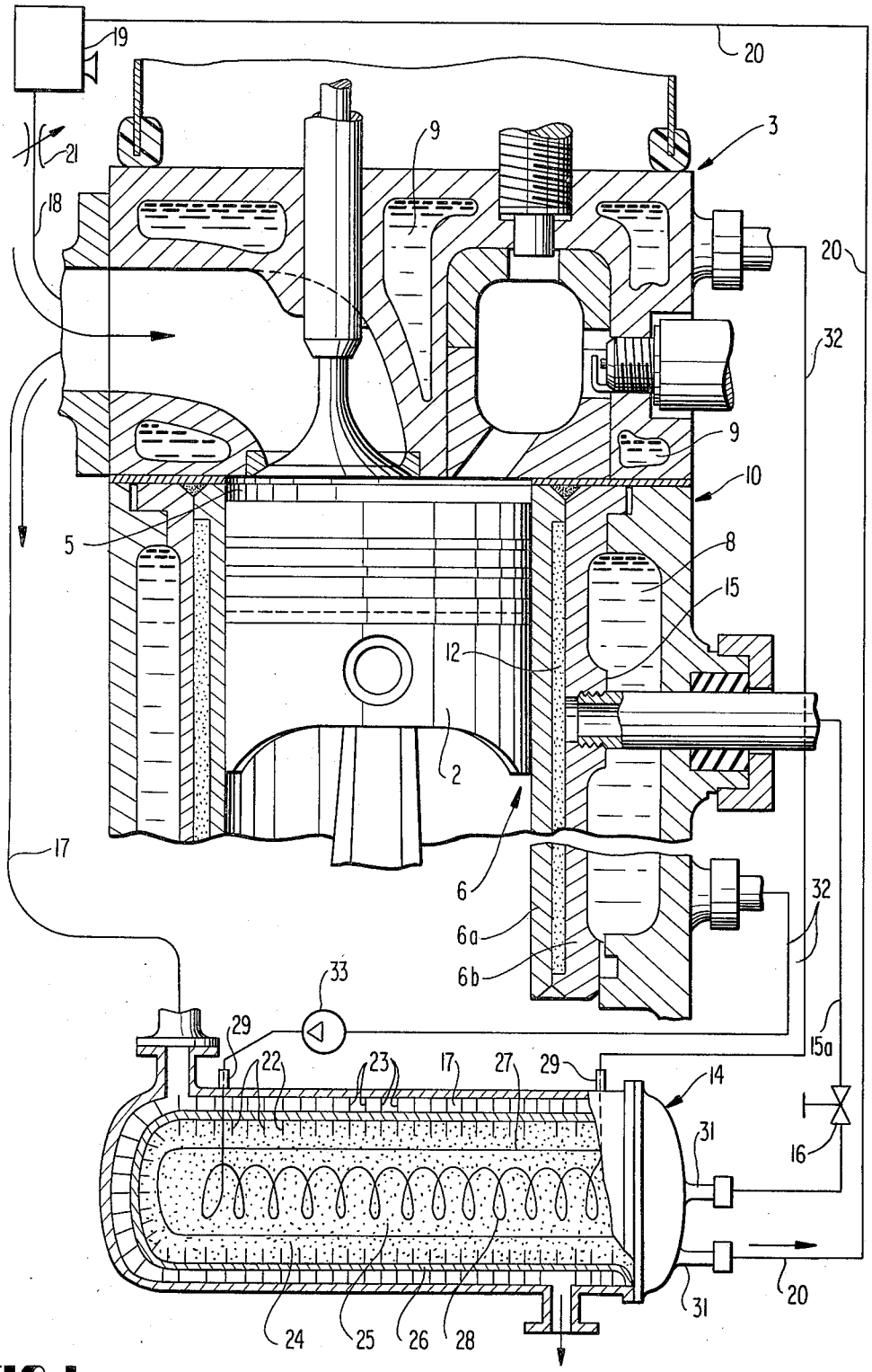
FIG. 1 is a somewhat schematic cross-sectional view through a part of an internal combustion engine with a pre-heat storage device built into the cylinder liner as well as the operative connection of the pre-heat storage device with a main storage device in accordance with the present invention.
Figure 2:
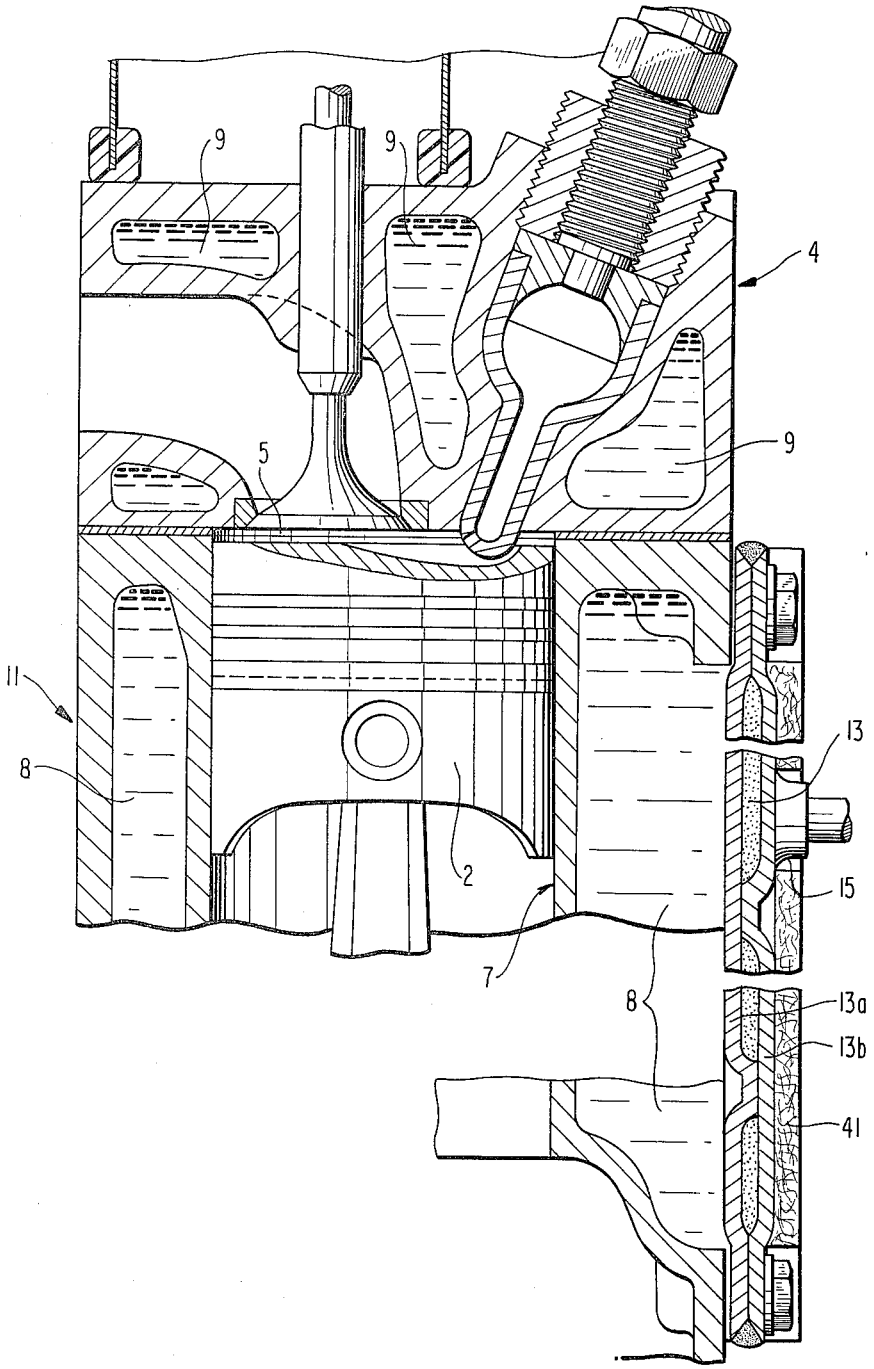
FIG. 2 is a partial cross-sectional view through a modified embodiment of an internal combustion engine with a pre-heat storage device in accordance with the present invention.

Referring now to the drawing wherein like reference numerals are used throughout the various views to designate like parts, and more particularly to FIGS. 1 and 2, in the two internal combustion engines illustrated in these two figures, a piston 2 is guided to reciprocate up and down in a cylinder liner generally designated by reference numeral 6 and 7, respectively. The engine block generally designated by reference numerals 10 and 11, respectively, which belongs to the internal combustion engine, is provided with a cylinder head generally designated by reference numerals 3 and 4, respectively. The working space 5 is enclosed by th aforementioned engine parts. The walls delimiting the working space are cooled by a cooling water jacket 8, respectively, by spaces 9 filled with cooling water in the cylinder head 3, respectively, 4.

In the embodiment according to FIG. 1, a pre-heat storage device 12 is provided in the cylinder liner 6. The latter is made for this purpose of two liners **6*a* and 6*b* which are welded together at their end faces in a hydrogen-tight manner. A connection 15 for the supply, respectively, discharge of hydrogen, is provided at the outer liner 6*b*. The pre-heat storage device 12 is operatively connected with a main storage device generally designated by reference numeral 14 for hydrogen by way of a line 15*a* and a closure valve 16. Hydrogen can be supplied from the main storage device 14 to the pre-heat storage device 12 with an open valve 16 during the cold start phase or also before, so that the pre-heat storage device 12** heats up and together therewith the internal combustion engine is heated up rapidly.

The metal hydride storage device 14 is illustrated in detail in FIG. 1 in the form of one possible embodiment; a certain particularity of this storage device resides in the fact that it can be supplied both with a liquid as also with a gaseous heat-exchanging medium. A granulate 24 of a suitable metal hydride, respectively, metal or metal alloy adapted to be hydrated is contained within an inner pressure vessel 26 of a material that is diffusion-impervious with respect to hydrogen. An outer pressure vessel is placed about the inner pressure vessel 26 while maintaining an intermediate space. Internal heat-exchanger ribs 22 provided on the inside of the vessel 26 protrude into the interior of the granulate 24, which have the task to establish as good a heat-conducting connection as possible between the interior container wall and the granulate. Similarly, heat-exchanger ribs 23 are provided on the outside of the inner container which have the task to establish as good a heat-transfer as possible from a gaseous medium flowing through the intermediate space to the container wall. The engine exhaust gas is conducted during engine operation through the intermediate space formed between the two containers. A cooling coil 28 is embedded in the interior of the granulate 24 which is connected by way of the connections 29 with the cooling water circulatory system 32 of the engine equipped with a circulating pump 33. The interior of the granulate 24 is reached by way of the cooling coil 28 whereas the outer zone of the granulate can be reached by way of the casing 26 and the ribs 22 provided thereon. Of the gas connections 31 mounted in the cover flangedly fastened at its end face, which are connected—eventually by a retention sieve—with the hollow spaces of the granulate, one of the gas connections 31 leads to a mixture preparation device 19 by way of the line 20. The internal combustion engine sucks in a hydrogen/air mixture from the mixture preparation device 19 by way of the throttle device 21 and the mixture suction line 18. This mixture may be enriched additionally with liquid fuel, for example, with gasoline durng mixture operation of the internal combustion engine by way of an injection valve in a prechamber. A second one of the two connections 31 is connected with the preheat storage device 12, respectively, 13.

For purposes of improved heat conduction inside of the metal granulate, the latter may be sintered together or compressed form-stable. This is true both for the main storage device 14 as also for the pre-heat storage device 12, respectively, 13. It is appropriate if copper or aluminum chips are also compressed together with the metal hydride or metal alloy hydride granulate. The copper or aluminum chips do not hydrate and retain their good thermal properties also when the granules of the granulate material which are adapted to be hydrated are in fact hydrated. The pressed-in chips assure for a good heat flow in the compressed blank of metal hydride granules which are themselves poorly heat-conducting in the hydrated condition. The pore proportion in the granulate should amount to at least about 5% to about 10% in order to provide still sufficient gas-exchange channels inside of the compressed blank or sintered body.

The filling 25 of the inner metal hydride storage device encapsulated by the wall 27 and penetrated by the pipe coil consists of a low temperature metal hydride, for example, of titanium-iron-hydride, whereby with the use of such filling material, the storage device is adapted to be completely emptied of hydrogen at temperatures of −20° C. up to +80° C. (for example, cooling water) and at an excess pressure of 1 to 10 Bar. The outer storage device 24 between the walls 27 and 26 consists of a high temperature metal hydride, for example, of a magnesium-nickel hydride; at excess pressures of about 1 Bar, temperatures above about 300° C. are necessary in that case for the far-reaching emptying of the storage device. Such temperatures can be produced by means of the exhaust gases if the exhaust gas lines 17 are heat-insulated.

The operation of the pre-heat storage device is now briefly as follows:

Starting from a metallic condition of the pre-heat storage device 12, the closure valve 16 in the hydrogen line 15*a* is opened prior to or during the beginning of the cold start, as a result of which, hydrogen can flow from the main storage device 14 into the pre-heat storage device 12. If the temperature level of the metal hydride in both storage devices, namely, in the pre-heat storage device 12 and in the main storage device 14, are equal, then hydrogen will exist in the main storage device 14 at a higher pressure than in the pre-heat storage device 12 at the temperature prevailing in both storage devices at the beginning of the cold-starting operation by reason of the larger storage capacity of the main storage device and by reason of a minimum filling condition of the main storage device which can be assumed, so that a certain dissociation pressure can be exerted from the main storage device on the pre-heat storage device which leads to a storage of hydrogen in the metal parts of the pre-heat storage device. The latter thereby heats up very strongly and gives off its heat to the two liners 6*a* and 6*b* of the cylinder liner 6. This is true if the main storage device 14 is fully hydrated, i.e., if it possesses pressures of the order of magnitude of 50 Bar, whereas the pre-heat storage device is non-hydrated. The capacity differences between the main storage device and the pre-heat storage device (factor 100) assure that the pressure in the main storage device has not dropped considerably after the filling of the pre-heat storage device. It is possible thereby to utilize the same hydride formers for both storage devices. Of course, also metal hydrides with different formation enthalpies can be utilized; whereby it is desirable to utilize a metal hydride in the pre-heat storage device which possesses a high formation enthalpy (higher temperature level and larger released heat quantity), whence the heating up process can be accelerated. As a result of the heating up of the storage device 12, the walls of the working space 5 are warmed-up directly and after a certain length of time also the cooling water of the engine. The warm-up phase is considerably shortened thereby. If the closure valve 16 is intentionally opened two to three minutes prior to the starting of the internal combustion engine, then during the starting of the internal combustion engine, already a sufficiently preheated working space is present so that one can reckon with qualitatively better exhaust gases immediately from the start.

If the internal combustion engine has reached its operating temperature, then the drop of the dissociatiion pressure reverses. With a strongly heated pre-heating storage device, the hydrogen exists within the same at a higher pressure than in the main storage device 14. The pre-heat storage device which has returned to the metallic dehydrated condition, represents in this condition a charged heat storage device which is charged by engine waste heat. It cannot lose its heat stored in chemically bound form by radiation or convection. At the latest, when turning off the internal combustion engine in its operationally warmed-up condition, the closure valve 16 has to be closed in order that the metallic condition of the pre-heat storage device remains preserved up to the next cold-starting operation.

In the other embodiment of an internal combustion engine according to FIG. 2, the cylinder liner 7 illustrated therein is constructed in one piece with the associated engine block 11. An outwardly disposed wall of the cooling water jacket 8 at the engine block is constructed as plate-shaped pre-heat storage device 13 having two sheet metal walls 13*a* and 13*b* held at a distance from one another. The two plates are welded together gas-tight along the outer edge; they are simultaneously held tension- and compression-resistant at a distance by pressed-in warp-like embossments. A connection 15 for the supply, respectively, discharge of hydrogen is also arranged on this pre-heat storage device 13 in the same manner as shown in FIG. 1. The walls delimiting the working space 5 of the internal combustion engine are heated up in this embodiment from the pre-heat storage device 13 by convective heat-exchange by way of the cooling water. Even though the process of the pre-heating of the internal combustion engine possibly takes somewhat longer than in the embodiment according to FIG. 1, the construction and arrangement of the pre-heat storage device 13 is somewhat simpler in comparison to that of FIG. 1. In order that the pre-heat storage device gives off its heat to the cooling water of the cold engine to a far-reachingly predominant extent, but not to the outside air, a heat-insulating layer 41 is provided on the outside of the pre-heat storage device 13. If the pre-heat storage device 13 is directly built into the cooling water, then the insulation with respect to the outside atmosphere may be dispensed with. The operation of the pre-heat storage device in the embodiment of FIG. 2 is completely analogous to that of the embodiment according to FIG. 1 so that reference may be had to the preceding description of the embodiment of FIG. 1.

Figure 3:
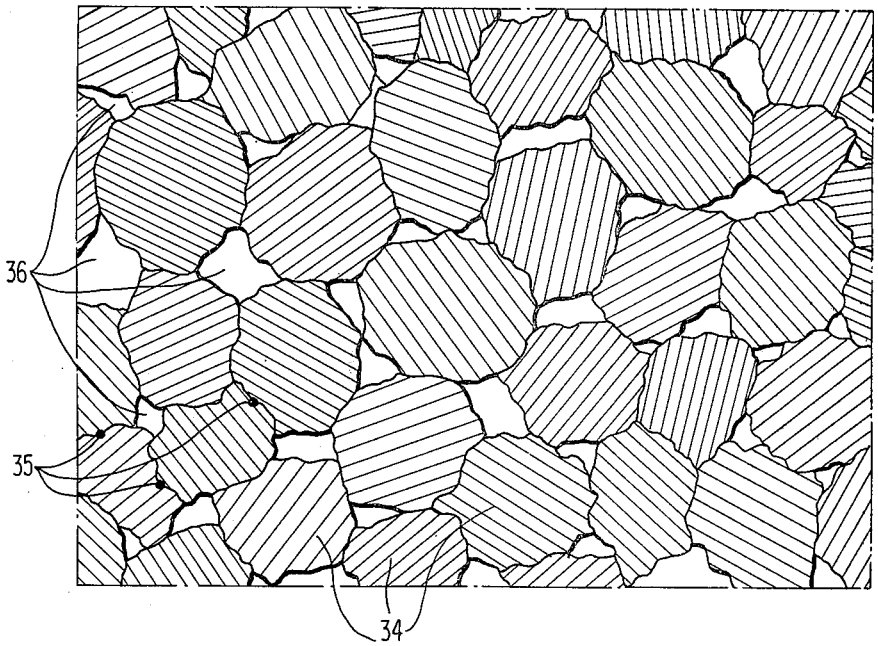
FIG. 3 is a cross section, on an enlarged scale, through a sintered structure of the pre-heat storage device.

FIG. 3 illustrates on a strongly enlarged scale a portion of a cross section through a porous sintered layer as is aimed at for the formation of the embedded layer. In the structure of this layer, granules 34 are areally welded together at the initially loose contact places in nearly molten condition under pressure and heat at these places 35. Pores 36 remain between the granules, which serve for the absorption of hydrogen in gaseous condition and which serve for the distribution of the hydrogen inside of the sintered structure. By reason of the melting of the granules in the sintered structure, the same are connected with each other providing good thermal conduction. The sintered structure itself is, as a whole, gap- and crack-free; the latter would prevent a good thermal conduction—in the metallic condition of the granules. A merging of the granules with the wall material, i.e., a good thermal contact, also comes into being at the contact places of the sintered structure with the adjoining hydrogen-impervious wall material.

Figure 4:
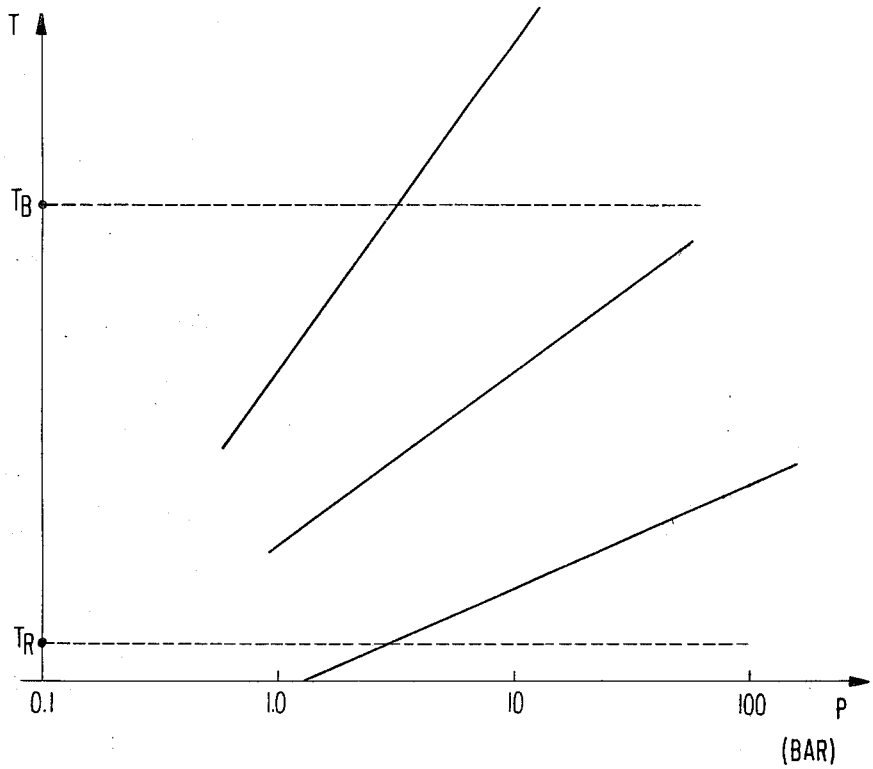
FIG. 4 is a diagram illustrating the pressure temperature curve of metal hydrides of different types.

The basic configuration of the characteristic curves of different metals or metal alloys adapted to be hydrated is plotted in the pressure/temperature diagram of FIG. 4. The configuration and position of these curves and of the metals coordinated thereto is known. One may now pick for the selection of an embedded layer appearing suitable for the pre-heat storage device the two limit values for the space or cooling off temperature $T_R$ and the operating temperature $T_B$ in a diagram containing the characteristic curves of the different metals along the temperature axis and to select a characteristic curve, respectively, the corresponding material lying between these two values. High temperature hydrides are, for example, magnesium-nickel-hydride ($Mg_2NiH_4$), magnesium or titanium hydride ($MgH_2$, $TiH_2$). A low temperature hydride would be, for example, titanium-iron-hydride.

While I have shown and described only two embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. An internal combustion engine having cylinder wall means adapted to be cooled and delimiting at least one working space means of an internal combustion engine, characterized in that a hydrogen-impervious enclosed metal hydride storage means having an enclosure means is provided in direct heat-conducting contact within the cylinder wall means forming a pre-heat storage means, and in that an interior of the enclosure means of the metal hydride storage means is operable to be selectively connected with at least one of a hydrogen source and a separate further hydrogen storage means.

2. An internal combustion engine according to claim 1, characterized in that the at least one of the hydrogen source and further hydrogen storage means is constructed also as further metal hydride storage means.

3. An internal combustion engine according to claim 2, characterized in that the further metal hydride storage means is larger by a multiple than the pre-heat storage means and in that both the pre-heat and further metal hydride storage means are filled with metal hydrides of about the same temperature level.

4. An internal combustion engine according to claim 2, characterized in that the further metal hydride storage means and the pre-heat storage means are dimensioned approximately identical as regards the hydrogen storage capacity thereof and in that—under the assumption of a certain substantially identical dissociation pressure—the temperature level of the pre-heat storage means is higher by about 60° to 80° C. than that of the further metal hydride storage means.

5. An internal combustion engine according to claim 4, characterized in that the engine is supplied at least partially with hydrogen from the further metal hydride storage means as fuel.

6. An internal combustion engine according to claim 2, 3 or 4, characterized in that a check valve means which is operable to be selectively opened and which closes in the direction toward the pre-heat storage means is arranged in a connecting line between the two storage means.

7. An internal combustion engine according to claim 2 or 3, characterized in that the engine is supplied at least partially with hydrogen from the further metal hydride storage means as fuel.

8. An internal combustion engine having an engine block means adapted to be cooled, said engine block means comprising cylinder wall means delimiting at least one working space means of the internal combustion engine, and outwardly disposed wall means, said cylinder wall means and said outwardly disposed wall means delimiting a water jacket means, characterized in that a hydrogen-impervious enclosed metal hydride storage means having an enclosure means is provided in direct heat-conducting contact within at least a part of the outwardly disposed wall means, and in that an interior of the enclosure means of the metal hydride storage means is operable to be selectively connected with at least one of a hydrogen source and a separate further hydrogen storage means.

* * * * *